US008764231B2

(12) United States Patent
Chung et al.

(10) Patent No.: US 8,764,231 B2
(45) Date of Patent: Jul. 1, 2014

(54) LIGHT-EMITTING DIODE LIGHT SOURCE

(75) Inventors: Hsiang-Chi Chung, Hsinchu County (TW); Ji-Feng Chen, Taipei (TW); Hung-Lieh Hu, Hsinchu (TW); Chen-Kun Chen, Changhua County (TW)

(73) Assignee: Industrial Technology Research Institute, Hsinchu (TW)

( * ) Notice: Subject to any disclaimer, the term of this patent is extended or adjusted under 35 U.S.C. 154(b) by 269 days.

(21) Appl. No.: 13/410,312

(22) Filed: Mar. 2, 2012

(65) Prior Publication Data

US 2013/0114256 A1 May 9, 2013

Related U.S. Application Data

(60) Provisional application No. 61/557,352, filed on Nov. 8, 2011.

(51) Int. Cl.
*F21V 5/00* (2006.01)

(52) U.S. Cl.
USPC ..... 362/244; 362/545; 362/615

(58) Field of Classification Search
USPC ..... 362/244, 612, 615, 545, 228
See application file for complete search history.

(56) References Cited

U.S. PATENT DOCUMENTS

| | | | | |
|---|---|---|---|---|
| 7,607,811 | B2 * | 10/2009 | Okada | 362/545 |
| 7,736,035 | B2 | 6/2010 | Chinniah et al. | |
| 8,256,943 | B2 * | 9/2012 | Nagafuchi et al. | 362/545 |
| 2010/0264799 | A1 | 10/2010 | Liu et al. | |
| 2010/0301353 | A1 | 12/2010 | Pabst et al. | |
| 2010/0328938 | A1 | 12/2010 | Chen et al. | |
| 2011/0095686 | A1 | 4/2011 | Falicoff et al. | |
| 2011/0110093 | A1 | 5/2011 | Hsu | |
| 2011/0141726 | A1 | 6/2011 | Xue et al. | |
| 2011/0163683 | A1 | 7/2011 | Steele et al. | |
| 2011/0195335 | A1 | 8/2011 | Goebel et al. | |

FOREIGN PATENT DOCUMENTS

| | | |
|---|---|---|
| CN | 201014300 | 1/2008 |
| CN | 102162601 | 8/2011 |
| TW | 201104170 | 2/2011 |
| TW | M404313 | 5/2011 |

OTHER PUBLICATIONS

Luo et al., "Thermal Design of a 16W LED Bulb Based on Thermal Analysis of a 4W LED Bulb," 2010 Electronic Components and Technology Conference, 2010, p. 1906-1911.

Chaves et al., "Virtual filaments that mimic conventional light bulb filaments," Proc. of SPIE, vol. 5529, 2004, p. 120-129.

(Continued)

*Primary Examiner* — Vip Patel
(74) *Attorney, Agent, or Firm* — Jianq Chyun IP Office

(57) ABSTRACT

An LED light source includes a carrier, a plurality of LED chips and at least one set of lenses. The carrier has a mounting surface and the LED chips are mounted on the mounting surface. The set of lenses disposed on the carrier includes a first lens and a second lens, and the first lens encapsulates one of the LED chips and a lighting pattern provided from the LED chip encapsulated by the first lens is converted into a first lighting pattern. The second lens encapsulates one of the LED chips and a lighting pattern provided from the LED chip encapsulated by the second lens is converted into a second lighting pattern. The second lighting pattern is different from or compensates the first lighting pattern.

13 Claims, 10 Drawing Sheets

(56) References Cited

OTHER PUBLICATIONS

Ou et al., "'No blue' LED solution for photolithography room illumination," Proc. of SPIE, vol. 7617, 2010, p. 76170Z-1-76170Z-7.
Wei et al., "LEDs on curved ceramic substrate with primary optics for modification of luminous intensity," Proc. of SPIE, vol. 8123, 2011, p. 81231I-1-81231I-6.
Nadarajah Narendran, "Is Solid-State Lighting Ready for the Incandescent Lamp Phase-Out?" OLEDs and Solid State Lighting Plenary Session, Aug. 21-25, 2011, p. 1-50.

* cited by examiner

LIGHT-EMITTING DIODE LIGHT SOURCE

CROSS-REFERENCE TO RELATED APPLICATION

This application claims the priority benefits of U.S. provisional application Ser. No. 61/557,352, filed on Nov. 8, 2011. The entirety of the above-mentioned patent application is hereby incorporated by reference herein and made a part of this specification.

TECHNICAL FIELD

The disclosure relates in general to a light source. More particularly, the disclosure relates to a light-emitting diode (LED) light source.

BACKGROUND

Because they save power and are environmentally friendly, high power LEDs have been rapidly developed and have become mainstream for illumination lamps.

Since incandescent lamps are now forbidden by law to be used or fabricated, high power LEDs have become the new generation light source and the development of high power LEDs by manufacturers has actively progressed. Generally, illumination coverage of incandescent lamps is about 300°, illumination coverage of fluorescent lamps is about 260°, and illumination coverage of LED light bulbs is about 120°. Since the currently available LED light bulbs have less illumination coverage, users have a mistaken impression that the LED light bulbs have insufficient illumination. Accordingly, some have proposed solutions to further increase the illumination coverage of the LED light bulbs, such as LED chips bonded onto a plurality of inclined surfaces of a heat sink, so that light emitted from the LED chips can propagate towards different directions and so obtain illumination coverage greater than 290°. However, it is difficult to bond the LED chips onto the inclined surface of a heat sink. In addition, the LED chips are required to be bonded onto two opposite surfaces of the heat sink. Accordingly, the design is disadvantageous to mass production.

SUMMARY

The disclosure provides an LED light source capable of providing a lighting pattern with large illumination coverage.

The disclosure provides an LED light source including a carrier, a plurality of LED chips and at least one set of lenses. The carrier has a mounting surface and the LED chips are mounted on the mounting surface. The set of lenses is disposed on the carrier and the set of lenses includes a first lens and a second lens. The first lens encapsulates one of the LED chips and a lighting pattern provided from the LED chip encapsulated by the first lens is converted into a first lighting pattern. The second lens encapsulates one of the LED chips and a lighting pattern provided from the LED chip encapsulated by the second lens is converted into a second lighting pattern. The second lighting pattern is different from the first lighting pattern.

Through the set of lenses, the disclosure can provide LED light sources with large illumination coverage and mixed lighting patterns. Accordingly, the LED light sources can be widely applied in illumination or other fields.

In order to make the aforementioned and other features and advantages of the disclosure more comprehensible, several embodiments accompanied with figures are described in detail below.

DETAILED DESCRIPTION

First Embodiment

Figure 1:
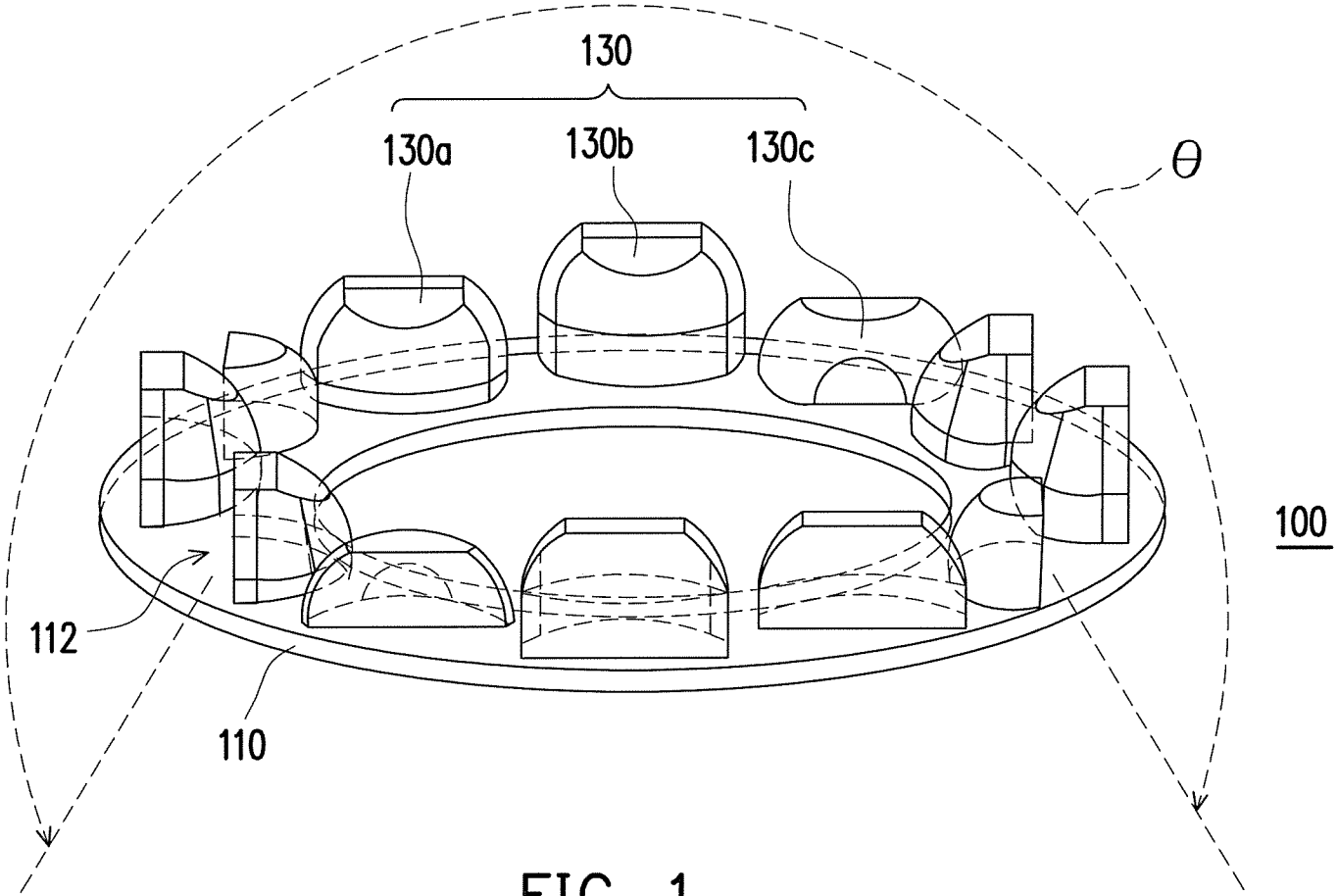
FIG. 1 is a schematic view illustrating an LED light source according to the first embodiment of the disclosure.
Figure 2C:
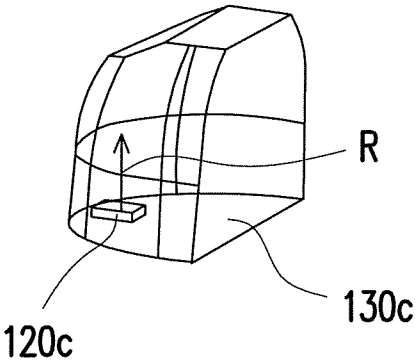
FIG. 2C is a schematic view of a third lens according to the first embodiment of the disclosure.
Figure 2B:
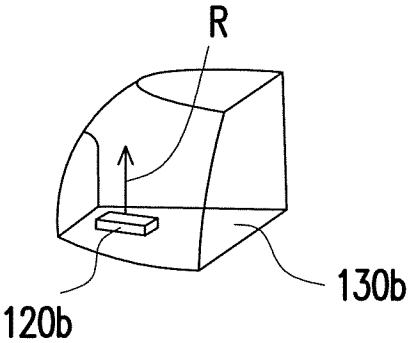
FIG. 2B is a schematic view of a second lens according to the first embodiment of the disclosure.
Figure 2A:
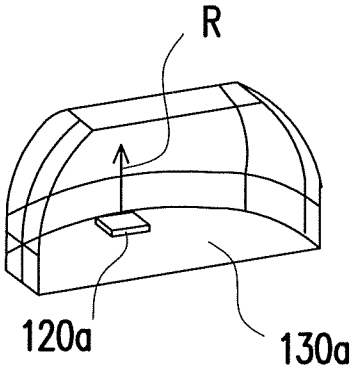
FIG. 2A is a schematic view of a first lens according to the first embodiment of the disclosure.

FIG. 1 is a schematic view illustrating an LED light source according to the first embodiment of the disclosure. FIG. 2A is a schematic view of a first lens according to the first embodiment of the disclosure. FIG. 2B is a schematic view of a second lens according to the first embodiment of the disclosure. FIG. 3A is a schematic view of an optical path in the first lens. FIG. 3B is a schematic view of an optical path in the second lens. Referring to FIGS. 1A, 2A, 2B, 3A and 3B, the LED light source 100 of this embodiment includes a carrier 110, a plurality of LED chips 120 and at least one set of lenses 130. The carrier 110 has a mounting surface 112, wherein the LED chips 120 are mounted on the mounting surface 112 and are electrically connected to the carrier 110. The chief ray R of the light emitted from each of the LED chips 120 is substantially perpendicular with the mounting surface 112. The set of lenses 130 is disposed on the carrier 110 and includes a first lens 130*a* and a second lens 130*b*. The first lens 130*a* encapsulates one of the LED chips 120*a* and the lighting pattern provided from the LED chip 120*a* encapsulated by the first lens 130*a* is converted into a first lighting pattern P1, P1'. The second lens 130*b* encapsulates another one of the LED chips 120*b* and a lighting pattern provided from the LED chip 120*b* encapsulated by the second lens 130*b* is converted into a second lighting pattern P2, P2'. The second lighting pattern P2, P2' is different from the first lighting pattern P1, P1'. In this embodiment, the carrier 110 is, for example, a ring-shaped carrier. However, the disclosure should not be construed as limited to the embodiments set forth herein.

When the LED chip 120*a*, the LED chip 120*b*, the first lens 130*a* and the second lens 130*b* are disposed on the carrier 110, the first lighting pattern P1, P1' and the second lighting pattern P2, P2' compensate each other through the optical design of the first lens 130*a* and the second lens 130*b*. Specifically, the first lighting pattern P1, P1', whose illumination coverage is greater than 90°, can be obtained through the optical design of the first lens 130*a*. The first lighting pattern P1 represents the light distribution at the upper side of the carrier 110, and the first lighting pattern P1' represents the light distribution at the lower side of the carrier 110. Similarly, the second lighting pattern P2, P2', whose illumination coverage is greater than 90°, can be obtained through the optical design of the second lens 130*b*. The second lighting pattern P2 represents the light distribution at the upper side of the carrier 110, and the second lighting pattern P2' represents the light distribution at the lower side of the carrier 110.

Since the first lighting pattern P1, P1' and the second lighting pattern P2, P2' are both lighting patterns whose illumination coverage is greater than 90°, the illumination coverage of the mixed lighting pattern formed by overlapping the first lighting pattern P1, P1' and the second lighting pattern P2, P2' is greater than 180°. In other words, the combination of the first lens 130*a* and the second lens 130*b* can provide a mixed lighting pattern whose illumination coverage is greater than 180°.

Figure 4A:
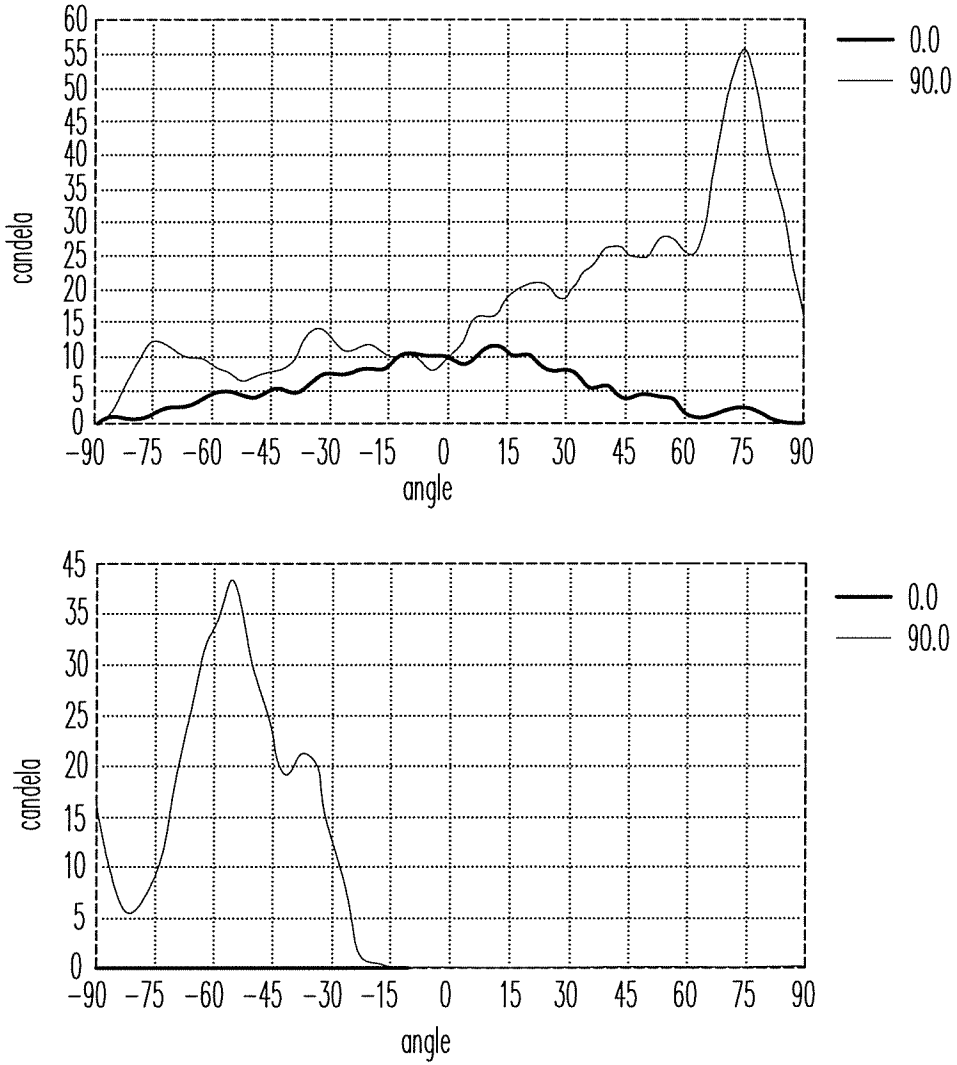
FIG. 4A is a schematic view of first lighting patterns P1 and P1'.
Figure 4A:
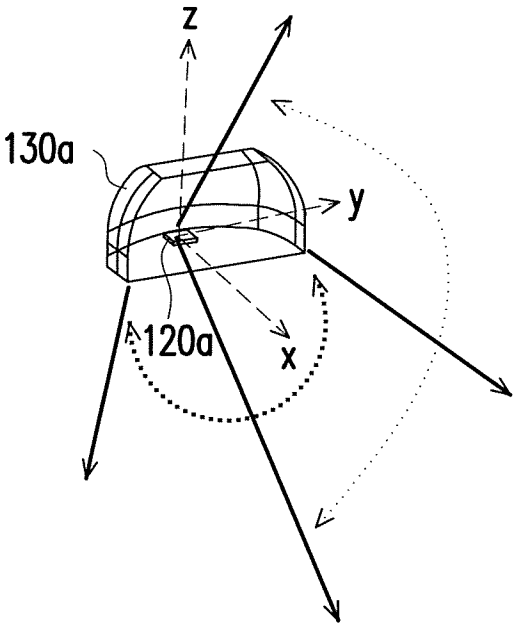
Figure 4B:
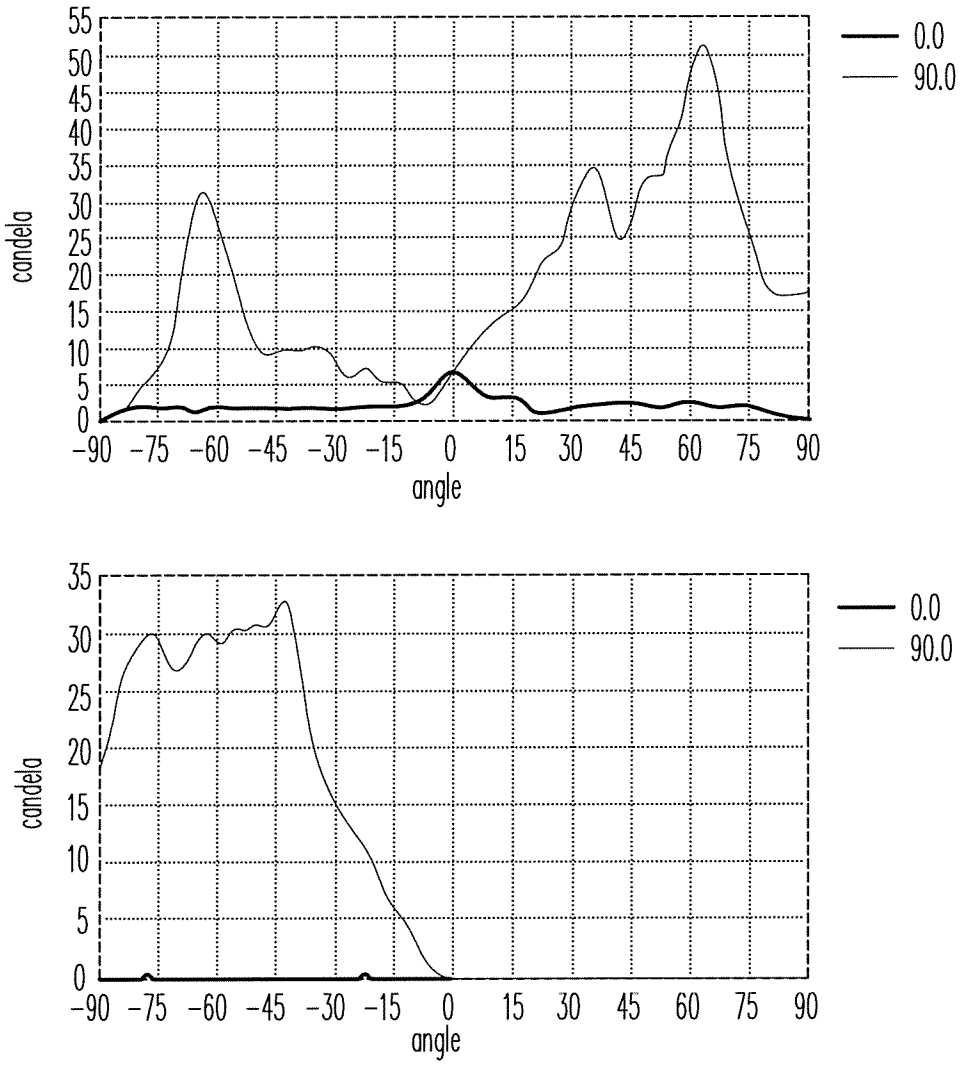
FIG. 4B is a schematic view of second lighting patterns P2 and P2'.
Figure 4B:
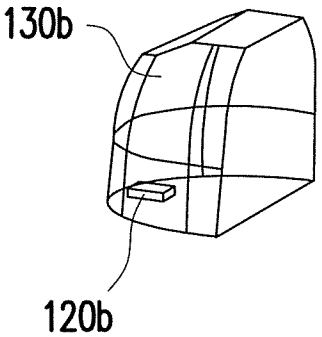

FIG. 4A is a schematic view of the first lighting patterns P1 and P1'. FIG. 4B is a schematic view of the second lighting patterns P2 and P2'. Referring to FIG. 4A and FIG. 4B, the upper right part of FIG. 4A is a graphical representation of the first lighting pattern P1, the lower right part of FIG. 4A is a graphical representation of the first lighting pattern P1', the upper right part of FIG. 4B is a graphical representation of the second lighting pattern P2, and the lower right part of FIG. 4B is a graphical representation of the second lighting pattern P2'.

As shown in FIG. 4A and FIG. 4B, after the light emitted from the LED chip 120*a* and the LED chip 120*b* propagates through the first lens 130*a* and the second lens 130*b* respectively, the light distribution of the LED chip 120*a* along the horizontal direction (X-Y plane) is a Lambertian distribution. Also, the light distribution of the LED chip 120*b* along the horizontal direction (X-Y plane) is a Lambertian distribution. In addition, the light distribution of the LED chip 120*a* and the light distribution of the LED chip 120*b* along the vertical direction (X-Z plane) are different from or compensate each other. The difference or compensation of the first lighting pattern P1, P1' and the second lighting pattern P2, P2' is capable of enhancing the illumination coverage of the LED light source 100.

As shown in FIG. 4A and FIG. 4B, the first lighting pattern P1, P1' and the second lighting pattern P2, P2' have similar illumination coverage, but the light distribution of the first lighting pattern P1, P1' and the light distribution of the second lighting pattern P2, P2' along the vertical direction are different from each other.

Figure 3C:
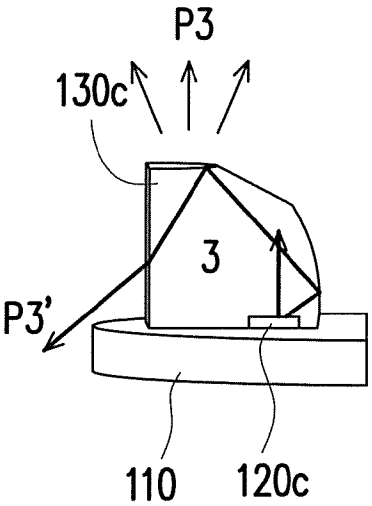
FIG. 3C is a schematic view of an optical path in the third lens.
Figure 3B:
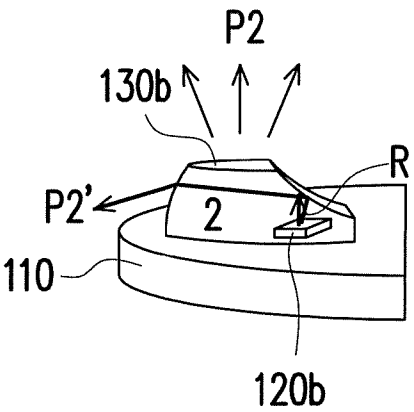
FIG. 3B is a schematic view of an optical path in the second lens.
Figure 3A:
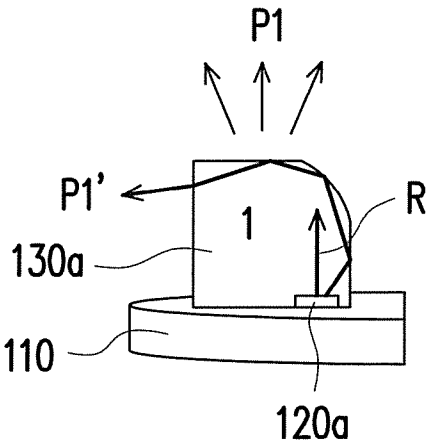
FIG. 3A is a schematic view of an optical path in the first lens.
Figure 4C:
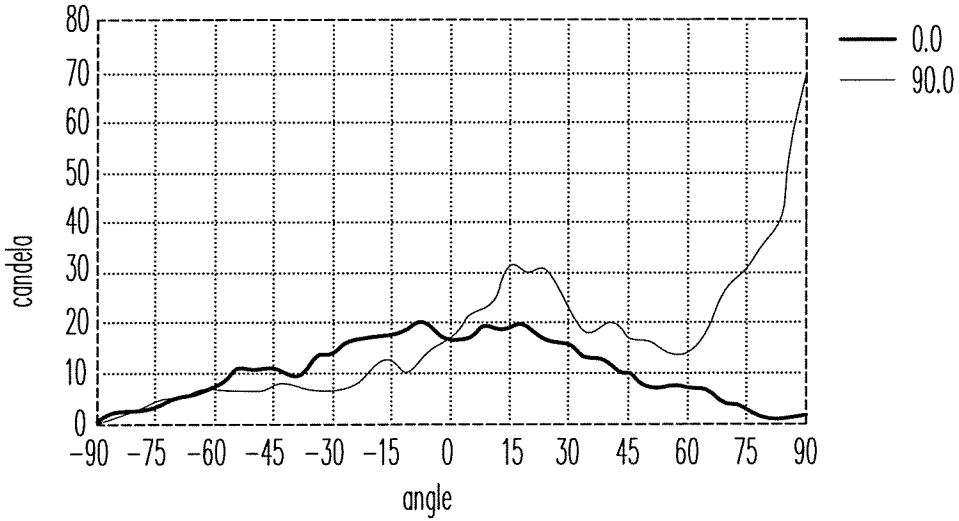
FIG. 4C is a schematic view of third lighting patterns P3 and P3'.
Figure 4C:
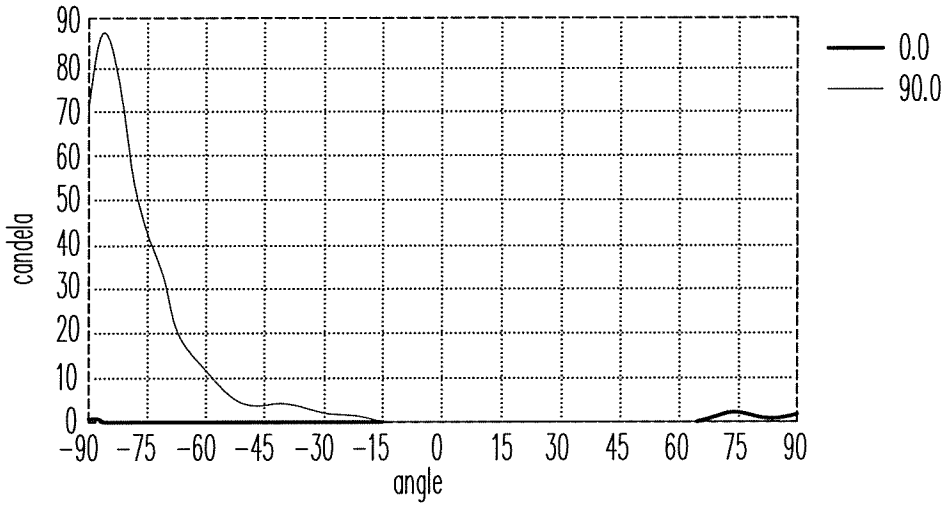
Figure 4C:
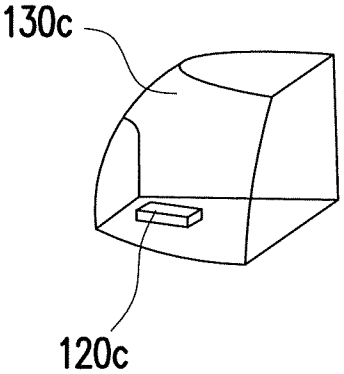

FIG. 3C is a schematic view of an optical path in the third lens. FIG. 4C is a schematic view of the third lighting patterns P3 and P3'. Referring to FIG. 1, FIG. 3C and FIG. 4C, the set of lenses 130 may further include a third lens 130*c*, the third lens 130*c* encapsulates the LED chip 120*c* and a lighting pattern provided from the LED chip 120*c* encapsulated by the third lens 130*c* is converted into a third lighting pattern P3, P3'. The third lighting pattern P3, P3' is different from both the second lighting pattern P2, P2' and the first lighting pattern P1, P1'. In this embodiment, the third lighting pattern P3, P3', whose illumination coverage is greater than 90°, can be obtained through the optical design of the third lens 130*c*.

As shown in FIG. 4A, FIG. 4B and FIG. 4C, after the light emitted from the LED chip 120*a*, the LED chip 120*b* and the LED chip 120*c* propagates through the first lens 130*a*, the second lens 130*b* and the third lens 130*c* respectively, the light distribution of each of the LED chips 120*a*, 120*b* and 120*c* along the horizontal direction (X-Y plane) is a Lambertian distribution. In addition, the light distribution of the LED chip 120*a*, the light distribution of the LED chip 120*b* and the light distribution of the LED chip 120*c* along the vertical direction (X-Z plane) are different from or compensate each other. The difference or compensation of the first lighting pattern P1, P1', the second lighting pattern P2, P2' and the third lighting pattern P3, P3' is capable of enhancing the illumination coverage θ (shown in FIG. 1) of the LED light source 100.

Since the first lighting pattern P1, P1', the second lighting pattern P2, P2' and the third lighting pattern P3, P3' are all lighting patterns whose illumination coverage is greater than 90°, the illumination coverage θ (shown in FIG. 1) of the mixed lighting pattern formed by overlapping the first lighting pattern P1, P1', the second lighting pattern P2, P2' and the third lighting pattern P3, P3' is greater than 270°. In other words, the combination of the first lens 130*a*, the second lens 130*b* and the third lens 130*c* can provide a mixed lighting pattern whose illumination coverage is greater than 270°.

As shown in FIG. 4A, FIG. 4B and FIG. 4C, the first lighting pattern P1, P1', the second lighting pattern P2, P2' and the third lighting pattern P3, P3' have similar illumination coverage, but the light distribution of the first lighting pattern P1, P 1', the light distribution of the second lighting pattern P2, P2' and the light distribution of the third lighting pattern P3, P3' along the vertical direction are different from each other.

Figure 5:
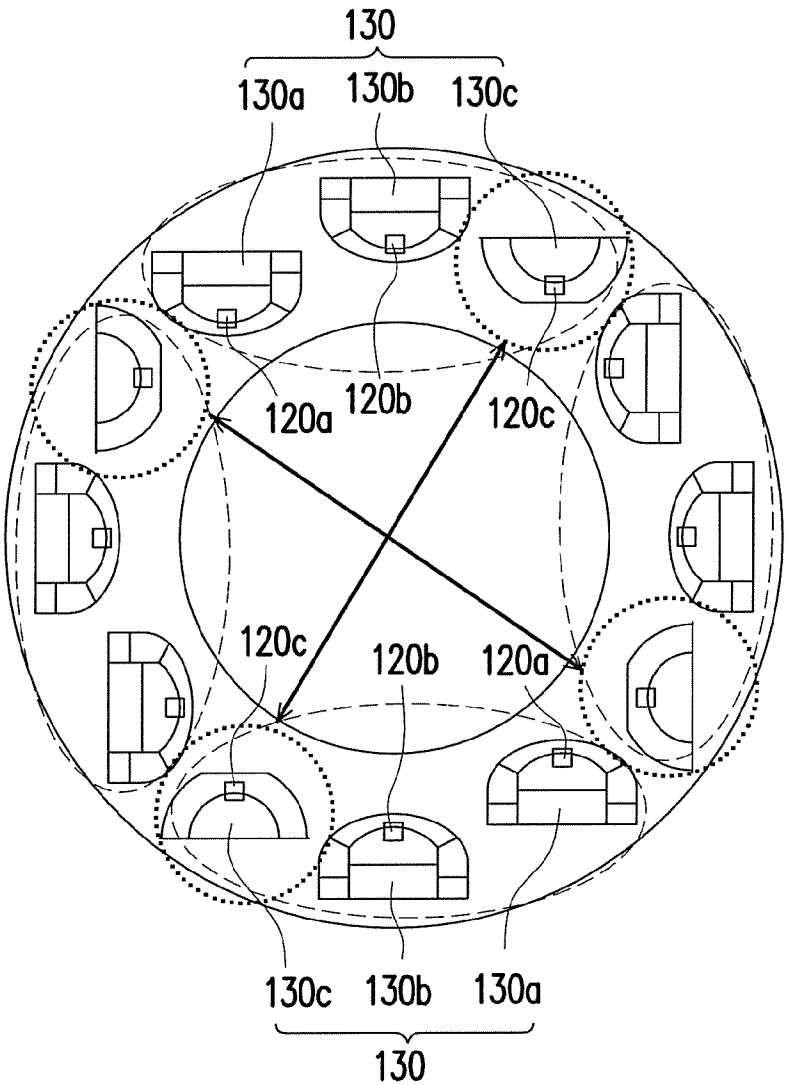
FIG. 5 is a top view of the LED light source.

FIG. 5 is a top view of the LED light source 100. Referring to FIG. 5, the quantity of the set of lenses 130 may be greater than one (four sets of lenses 130 are shown in FIG. 1 for illustration), and the four sets of lenses 130 are arranged and installed on the mounting surface 112 of the carrier 110 along a ring-shaped path. Specifically, each first lens 130*a* and another first lens 130*a* are respectively disposed at two opposite sides of the center of the carrier 110, each second lens 130*b* and another second lens 130*b* are respectively disposed at two opposite sides of the center of the carrier 110, and each third lens 130*c* and another third lens 130*c* are respectively disposed at two opposite sides of the center of the carrier 110.

As shown in FIG. 5, the LED chips 120*a*, 120*b*, 120*c* respectively encapsulated by the first lens 130*a*, the second lens 130*b* and the third lens 130*c* are bonded onto the carrier 110 and have substantially the same orientation. However, the disclosure should not be construed as limited to the embodiments set forth herein. In an alternative embodiment, the LED chips 120*a*, 120*b*, 120*c* respectively encapsulated by the first lens 130*a*, the second lens 130*b* and the third lens 130*c* can be bonded onto the carrier 110 and have different orientations.

Furthermore, since the LED chips 120*a*, 120*b*, 120*c* and the set of lenses 130 are installed at the same side of the carrier 110 (mounted on the mounting surface 112), the die-bonding process of the LED chips 120*a*, 120*b*, 120*c* is not complicated.

Figure 6:
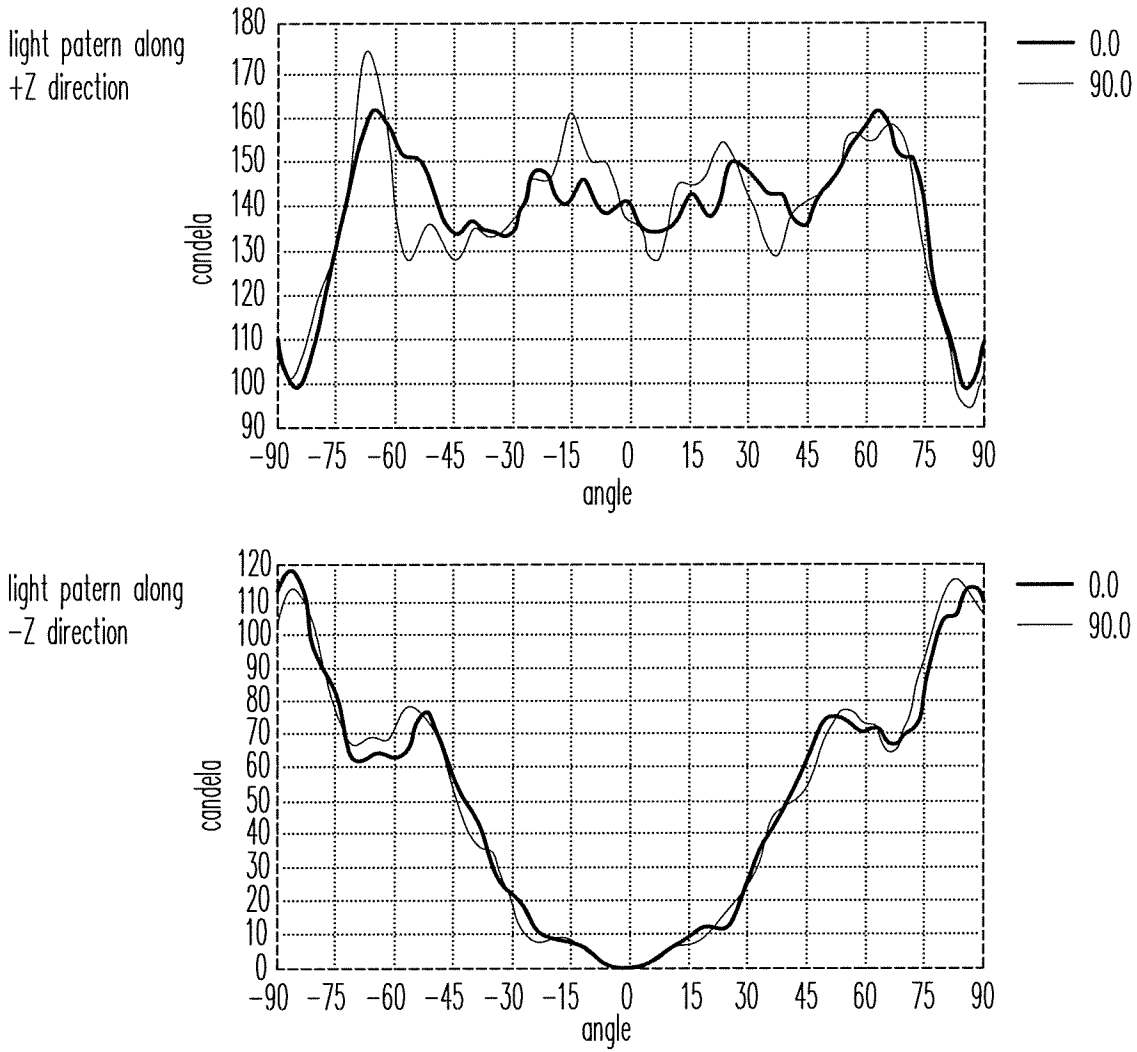
FIG. 6 is the mixed lighting pattern provided by the LED light source illustrated in FIG. 5.

FIG. 6 is the mixed lighting pattern provided by the LED light source illustrated in FIG. 5. Referring to FIG. 5 and FIG. 6, the illumination coverage of the mixed lighting pattern provided by the LED light source 100 (shown in FIG. 5) is about 270°. Z+: 180° and Z−: 90°. Accordingly, the LED light source 100 can be widely applied in illumination or other fields.

Second Embodiment

Figure 7:
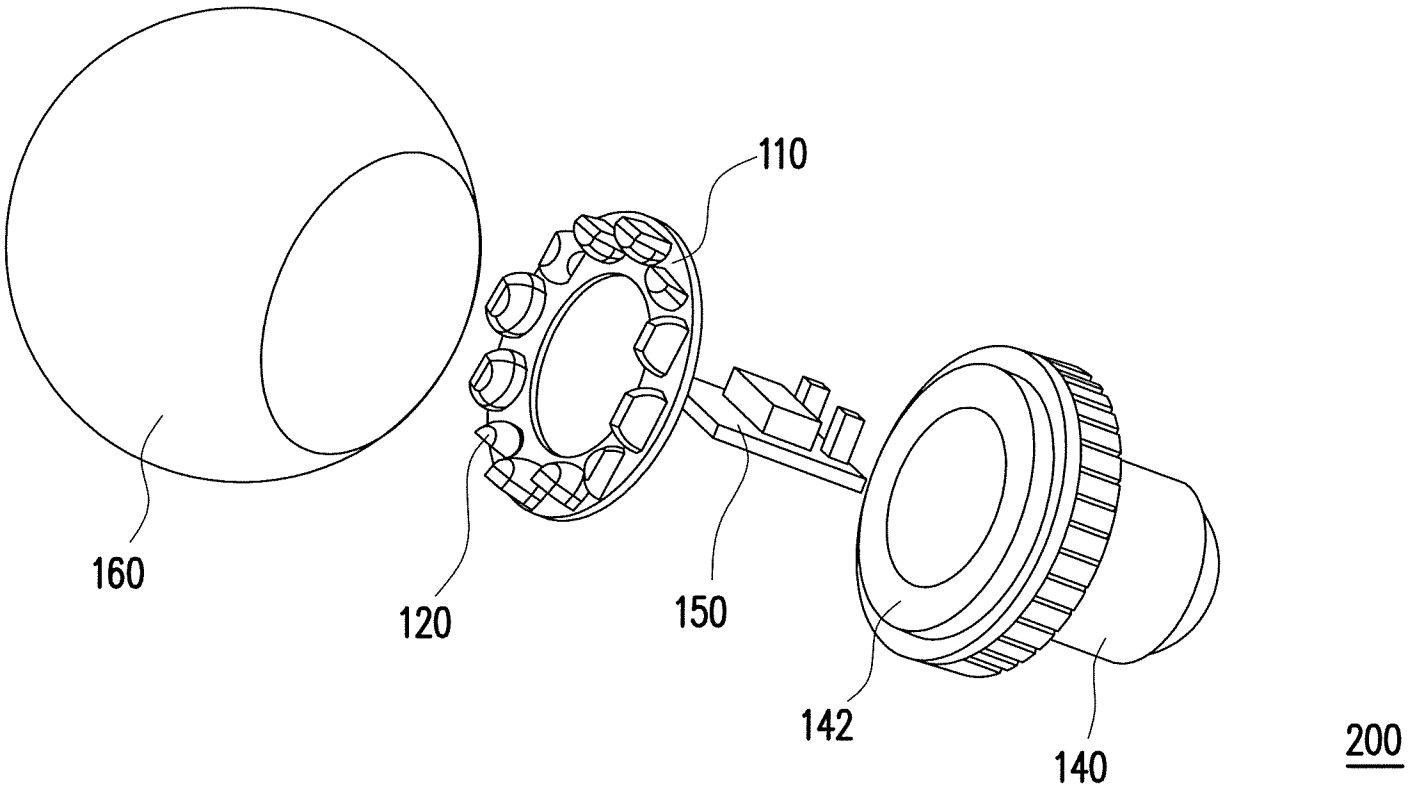
FIG. 7 is a schematic view illustrating an LED light source according to the second embodiment of the disclosure.

FIG. 7 is a schematic view illustrating an LED light source according to the second embodiment of the disclosure. Referring to FIG. 7, the LED light source 200 of this embodiment is similar to the LED light source 100 of the first embodiment except that the LED light source 200 further includes a heat dissipation lamp holder 140, a driving circuit 150 and a lamp shade 160. The driving circuit 150 is electrically connected to the carrier 110. For example, the carrier 110 and the driving circuit 150 are disposed on the heat dissipation lamp holder 140. The lamp shade 160 is disposed on the heat dissipation lamp holder 140 and covers the carrier 110, the LED chips 120 (not shown in FIG. 7) and the set of lenses 130.

Figure 8:
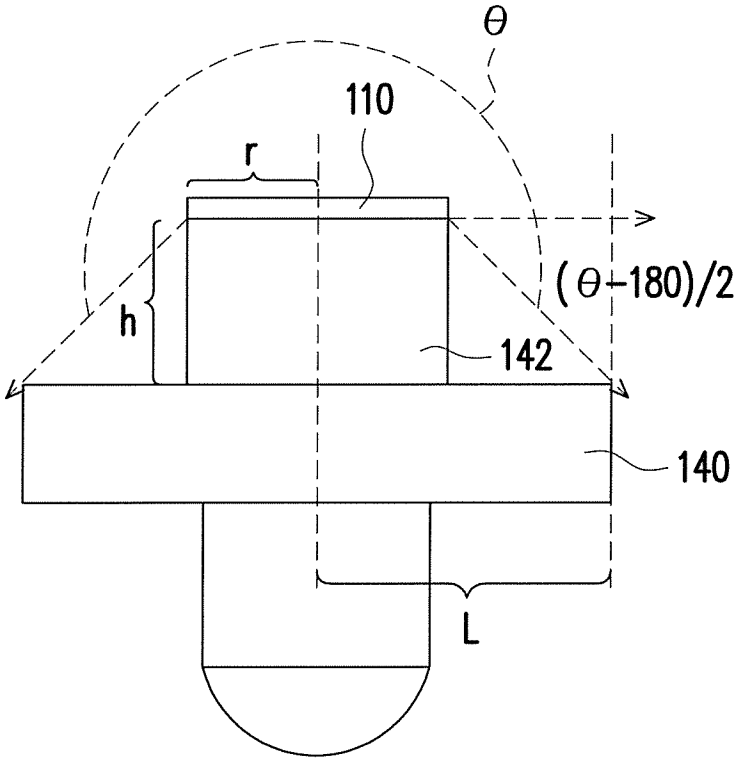
FIG. 8 is a schematic view of a heat dissipation lamp holder according to the second embodiment of the disclosure.

FIG. 8 is a schematic view of a heat dissipation lamp holder according to the second embodiment of the disclosure. Referring to FIG. 8, the heat dissipation lamp holder 140 has a protruding portion 142 and the carrier 110 is disposed or installed on the protruding portion 142. In this embodiment, the dimension of the protruding portion 142 is smaller than that of the carrier 110 such that the light emitted from the LED chips is not blocked by the protruding portion 142. The radius of the heat dissipation lamp holder 140 is L, the illumination range of the LED light source 200 is θ, the radius of the carrier 110 is r, and the height of the protruding portion 142 is h. Furthermore, the above-mentioned L, θ, r and h satisfy the following relationship:

$$L<r+h/\tan[(180-\theta)/2]$$

For example, when the radius r of the carrier 110 is 2 cm, the illumination coverage θ is 270° and the height h of the protruding portion 142 is 1 cm, the radius L of the heat dissipation lamp holder 140 should be equal to or less than 3 cm. In this case, the light emitted from the LED chips is not blocked by the heat dissipation lamp holder 140.

Through using the sets of lenses, the disclosure can provide LED light sources with large illumination coverage and mixed lighting pattern covering both the upper side and the lower side of the carrier. Accordingly, the LED light sources can be widely applied in illumination or other fields.

Although the disclosure has been described with reference to the above embodiments, it will be apparent to one of the ordinary skill in the art that modifications to the described embodiment may be made without departing from the spirit of the disclosure. Accordingly, the scope of the disclosure will be defined by the attached claims not by the above detailed descriptions.

What is claimed is:

1. A light-emitting diode (LED) light source, comprising:
a carrier having a mounting surface;
a plurality of LED chips, disposed on the mounting surface;
at least one set of lenses disposed on the carrier, the set of lenses comprising:
a first lens encapsulating one of the LED chips, wherein a lighting pattern provided from the LED chip encapsulated by the first lens is converted into a first lighting pattern; and
a second lens encapsulating one of the LED chips, wherein a lighting pattern provided from the LED chip encapsulated by the second lens is converted into a second lighting pattern.

2. The LED light source of claim 1, wherein the carrier comprises a ring-shaped carrier.

3. The LED light source of claim 1, wherein the first lighting pattern and the second lighting pattern compensate each other.

4. The LED light source of claim 1, wherein an illumination coverage of the first lighting pattern is greater than 90°, an illumination coverage of the second lighting pattern is greater than 90°, and a combination of the first lens and the second lens provides a mixed lighting pattern whose illumination coverage is greater than 180°.

5. The LED light source of claim 1 further comprising a third lens, wherein the third lens encapsulates one of the LED chips, the lighting pattern provided from the LED chip encapsulated by the third lens is converted into a third lighting pattern, the third lighting pattern is different from the second lighting pattern, and the third lighting pattern is different from the first lighting pattern.

6. The LED light source of claim 5, wherein the first lighting pattern, the second lighting pattern and the third lighting pattern compensate each other.

7. The LED light source of claim 5, wherein an illumination coverage of the first lighting pattern is greater than 90°, an illumination coverage of the second lighting pattern is greater than 90°, an illumination coverage of the third lighting pattern is greater than 90°, and a combination of the first lens, the second lens and the third lens provides a mixed lighting pattern whose illumination coverage is greater than 270°.

8. The LED light source of claim 1, wherein a quantity of the set of lenses is greater than one, the plurality of sets of lenses are arranged on the carrier along a ring-shaped path, and the plurality of sets of lenses are installed at a same side of the carrier.

9. The LED light source of claim 1 further comprising:
a heat dissipation lamp holder; and
a driving circuit, electrically connected to the LED chips, wherein the carrier and the driving circuit are disposed on the heat dissipation lamp holder.

10. The LED light source of claim 9 further comprising a lamp shade disposed on the heat dissipation lamp holder, wherein the lamp shade covers the carrier, the LED chips and the set of lenses.

11. The LED light source of claim 9, wherein the heat dissipation lamp holder comprises a protruding portion, and the carrier is disposed on the protruding portion.

12. The LED light source of claim 11, wherein an outer dimension of the protruding portion is smaller than that of the carrier.

13. The LED light source of claim 12, wherein a radius of the heat dissipation lamp holder is L, a radius of the carrier is r, and L, r satisfy the following relationship:

$$L<r+h/\tan[(180-\theta)/2]$$

where θ is an illumination range of the LED light source, and h is a height of the protruding portion.

* * * * *